US005102582A

United States Patent [19]

Zinnen

[11] Patent Number: 5,102,582

[45] Date of Patent: Apr. 7, 1992

[54] PROCESS FOR SEPARATING FATTY ACIDS AND TRIGLYCERIDES

[75] Inventor: Hermann A. Zinnen, Evanston, Ill.

[73] Assignee: UOP, Des Plaines, Ill.

[21] Appl. No.: 583,269

[22] Filed: Sep. 17, 1990

[51] Int. Cl.[5] ..... C11B 3/06

[52] U.S. Cl. ..... 554/190; 260/428; 260/428.5

[58] Field of Search ..... 260/428.5, 427, 428

[56] References Cited

U.S. PATENT DOCUMENTS

| | | | |
|---|---|---|---|
| 2,639,289 | 5/1953 | Vogel | 260/428 |
| 2,985,589 | 5/1961 | Broughton et al. | 210/34 |
| 3,040,777 | 6/1962 | Carson et al. | 137/525.15 |
| 3,422,848 | 1/1969 | Liebman et al. | 137/625.15 |
| 3,706,812 | 12/1972 | de Rosset et al. | 260/674 SA |
| 4,048,205 | 9/1977 | Neuzil et al. | 260/428 |
| 4,277,412 | 7/1981 | Logan | 260/428.5 |
| 4,284,580 | 8/1981 | Logan et al. | 260/428.5 |
| 4,310,440 | 1/1982 | Wilson et al. | 252/435 |
| 4,353,838 | 10/1982 | Cleary et al. | 260/419 |
| 4,521,343 | 6/1985 | Chao et al. | 260/419 |
| 4,642,397 | 2/1987 | Zinnen et al. | 568/934 |

OTHER PUBLICATIONS

Choudhary et al., Journal of Catalysis, vol. III, pp. 23 40 (1988).

Stach et al., Stud. Surf. Sci. Catal., vol. 28 (New Dev. Zeolite Sci. Techn.) pp. 539–546 (1986).

Dworezkov et al., Adsorptive Properties of Aluminophosphate Molecular Sieves Adsorption and Catlaysis on Oxide Surfaces (Che and Bond Editors) pp. 163–172 (1985).

Wu et al., *Nature*, vol. 346, Aug. 9, 1990, pp. 550–552.

Davis et al., *Nature*, vol. 331, pp. 698–699.

*Primary Examiner*—Jose G. Dees

*Assistant Examiner*—Deborah D. Carr

*Attorney, Agent, or Firm*—Thomas K. McBride; John F. Spears, Jr.; Jack H. Hall

[57] ABSTRACT

The separation of free fatty acids from triglycerides and/or diglycerides is performed by an adsorptive chromatographic process in liquid phase with a crystalline aluminophosphate, e.g., $AlPO_4$-5, $AlPO_4$-11 or $AlPO_4$-54, as the adsorbent. A ketone, having from 3 to 8 carbon atoms, such as 2-heptanone, or a mixture thereof, alone or admixed with a normal alkane can be selected as the desorbent.

10 Claims, 3 Drawing Sheets

PROCESS FOR SEPARATING FATTY ACIDS AND TRIGLYCERIDES

FIELD OF THE INVENTION

The field of art to which this invention belongs is the solid bed adsorptive separation of glycerides. More specifically, the invention relates to a process for separating free fatty acids from triglycerides by a process which employs an aluminophosphate.

BACKGROUND OF THE INVENTION

The separation of many classes of compounds by selective adsorption on molecular sieves or zeolites as well as other adsorbents is well known. Also, various separations based on the degree of unsaturation are known, e.g., esters of saturated fatty acids from unsaturated fatty acids with X or Y zeolites exchanged with a selected cation from U.S. Pat. No. 4,048,205, monoethanoid fatty acids from diethanoid fatty acids with cross-linked polystyrenes, e.g., "Amberlite" from U.S. Pat. No. 4,353,838. A process for separating a mixture of triglycerides, based on the iodine values, is shown in U.S. Pat. Nos. 4,277,412 and 4,284,580 in which permutite and aluminated silica gel adsorbents, respectively, can be used. The refining of oils by admixing them with magnesium silicate to adsorb coloring matter and free fatty acids from glyceride oils is disclosed in U.S. Pat. No. 2,639,289.

The adsorption properties of certain aluminophosphates have been reported. Choudhary et al, in the *Journal of Catalysis*, Vol. III, pp 23–40 (1988) discussed the adsorption of several alcohols and hydrocarbons on $AlPO_4$-5. Studies of the adsorption equilibrium of hydrocarbons, some N-compounds and water on $AlPO_4$-5 were reported by Stach et al in *Stud. Surf. Sci. Catal.*, Vol. 28, (New Dev. Zeolite Sci. Techn.) pp 539–546 (1986) and by Dworezkov et al in an article entitled *Adsorptive Properties of Aluminumphosphate Molecular Sieves* in Adsorption and Catalysis on Oxide Surfaces (Che and Bond Editors) pp 163–172 (1985). None of the above suggest the separation of fatty acids and triglycerides.

The synthesis and properties of the $AlPO_4$ series of aluminophosphate zeolites concerned here are set forth in U.S. Pat. No. 4,310,440 ($AlPO_4$-11) and Wu et al, *Nature*, Vol. 346, Aug. 9, 1990, pp 550–2, and Davis et al, *Nature*, Vol. 331 (1988) pp 698–9 (VPI-5 sometimes referred to herein as $AlPO_4$-54), respectively, which are incorporated herein by reference.

The invention herein can be practiced in fixed or moving adsorbent bed systems, but the preferred system for this separation is a countercurrent simulated moving bed system, such as described in Broughton U.S. Pat. No. 2,985,589, incorporated herein by reference. Cyclic advancement of the input and output streams can be accomplished by a manifolding system, which are also known, e.g., by rotary disc valves shown in U.S. Pat. Nos. 3,040,777 and 3,422,848. Equipment utilizing these principles are familiar, in sizes ranging from pilot plant scale (deRosset U.S. Pat. No. 3,706,812) to commercial scale in flow rates from a few cc per hour to many thousands of gallons per hour.

The functions and properties of adsorbents and desorbents in the chromatographic separation of liquid components are well known, but for reference thereto, Zinnen et al U.S. Pat. No. 4,642,397 is incorporated herein.

I have found adsorbents, which, in combination with certain desorbent liquids, will selectively adsorb all the fatty acids contained in various triglyceride/fatty acid feed materials; the triglycerides are relatively non-adsorbed and elute as a class near the void. Thus, the triglyceride components of the feed are eluted as raffinate and the fatty acids are adsorbed and eluted as extract by desorption with the desorbent. For feed material containing major amounts of triglycerides, this so-called rejective separation of the major component is desirable since utilities are lower and adsorbent capacity for the adsorbed components, is lower per unit of output product.

These desorbents are thermally stable and thus can be regenerated easily at elevated temperatures without collapsing the pore structure. Furthermore, since there are no metal exchange ions, they are deemed suitable for the separation of food products.

I have discovered a method for separating fatty acids, including mixtures of unsaturated and saturated fatty acids, as a class, from triglycerides. The triglycerides also may be a mixture of triglycerides, including saturated, monounsaturated and polyunsaturated.

SUMMARY OF THE INVENTION

The present invention is a process for separating free fatty acids from a feed mixture comprising free fatty acids and at least one triglyceride and/or diglyceride. The process comprises contacting the mixture at adsorption conditions with an adsorbent comprising a crystalline aluminophosphate molecular sieve. The fatty acids are selectively adsorbed to the substantial exclusion of the triglycerides. Next, the fatty acids are desorbed by a liquid ketone having from 3 to 8 carbon atoms or a mixture thereof with a normal alkane. Triglycerides are relatively unadsorbed by the molecular sieve and are removed before the fatty acids and, together with desorbent, constitute the raffinate. The desorbent may be selected from the ketones having up to 8 carbons, e.g., acetone, methyl ethyl ketone, the pentanones, hexanones, heptanones and octanones. Specific examples of ketones useful in the process are acetone, methylethyl ketone, diethyl ketone, methylpropyl ketone, 2-hexanone, 2-heptanone, 3-heptanone, 2-octanone, etc., and mixtures thereof with hydrocarbons. Other desorbent materials which may be used in the process for the separation of free fatty acids and triglycerides are esters, ethers, or mixtures thereof with hydrocarbons.

Other embodiments of my invention encompass details about feed mixtures, adsorbents, desorbent materials and operating conditions all of which are hereinafter disclosed in the following discussion of each of the facets of the present invention.

DETAILED DESCRIPTION OF THE INVENTION

Figure 1:
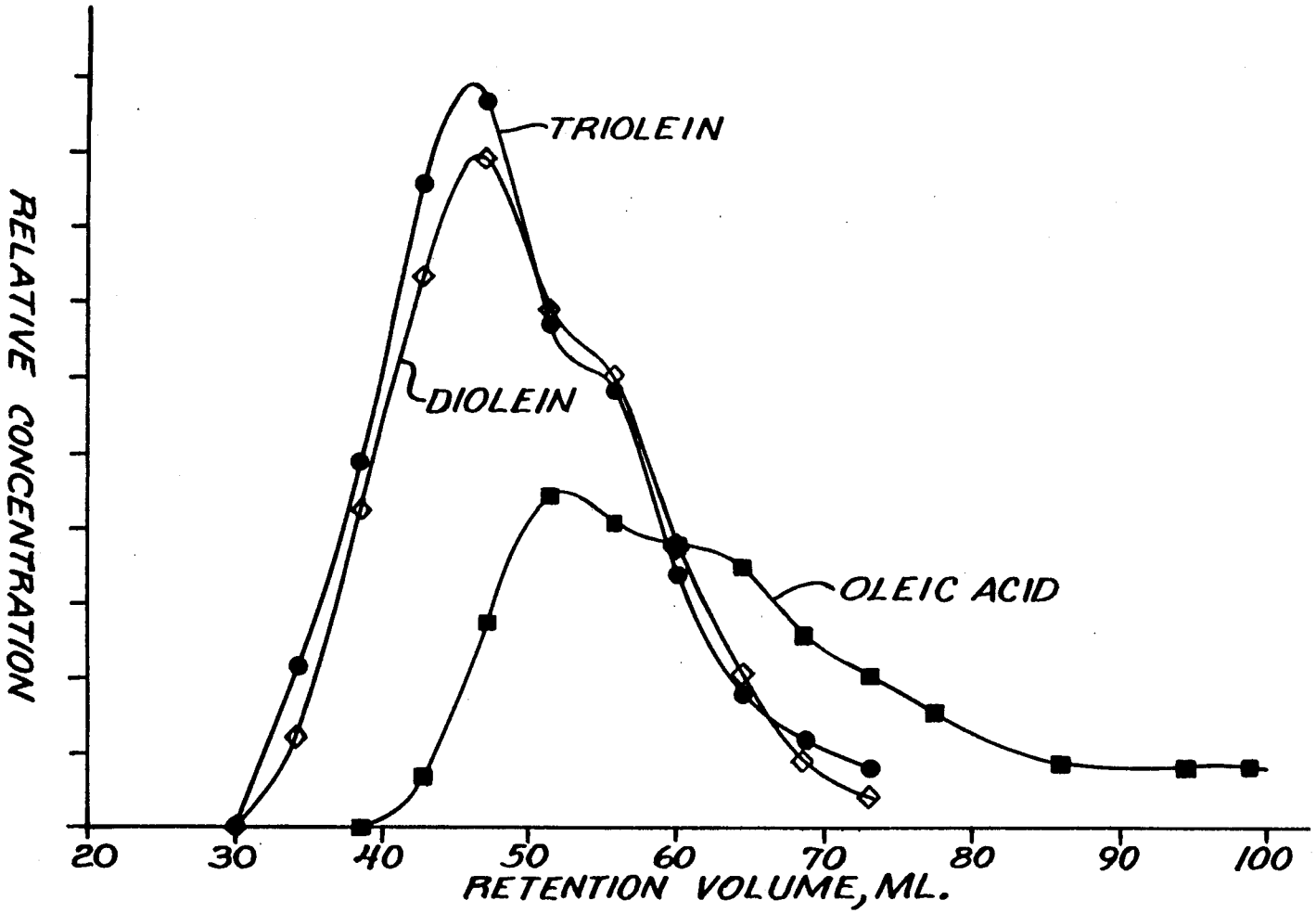
FIGS. 1 and 2 are chromatographic traces of two of the pulse tests of Example I showing the separation of free fatty acids from triglycerides with $AlPO_4$-11 adsorbent and 2-heptanone and 100% acetone, respectively, as the desorbent.

Highly unsaturated triglycerides are desirable oils for use in certain foods such a mayonnaise, salad dressings, etc. Such triglycerides can be produced in several ways, but an important route is via an interesterification process wherein triglyceride oils with a low degree of unsaturation can be upgraded by reaction with unsaturated fatty acids. The process may be catalyzed enzymically by a positionally selective lipase catalyst, e.g., *Candida cylindracal, Aspergillis niger, Geotrichum candidum* or various species of Rhizopus or chemically with an alkali metal or alkaline earth metal catalyst or a natural or synthetic zeolitic aluminosilicate. Such processes are disclosed, for example, in U.S. Pat. No. 4,275,081 (Unilever) and U.S. Pat. No. 3,328,439. The triglyceride fats or oils which may be fed to the interesterification reaction include linseed oil, soybean oil, cotton seed oil, corn oil, peanut oil, palm oil, sunflower oil, safflower oil, canola oil, tallow, lard, olive oil or other naturally occurring or synthetic fats or oils.

Naturally occurring fats and oils, containing substantial quantities of free fatty acids as well as triglycerides, may be fed directly to the separation process of the invention, e.g., palm oil, rice bran oil, etc. Partially refined oils or fats such as hydrolyzed canola oil, soybean, cotton seed or corn oil may also be used herein as the feedstock.

The preferred adsorbents for this are aluminophosphate molecular sieves having a pore size of at least about 6.1 Å and up to around 12 Å. Specific aluminophosphate molecular sieves which are effective in the separation of triglycerides (as a class) from fatty acids (as a class) are $AlPO_4$-5, $AlPO_4$-11 and $A1PO_4$-54 (referred to in the literature as VPl-5). X-ray crystallography shows that $AlPO_4$-5 and $AlPO_4$-54 have 12 and 18 membered rings, respectively, with a pore size of 8 Å and 12.5 Å, respectively, while $AlPO_4$-11 has a 10-membered ring and a pore size of 6.1 Å.

$AlPO_4$-5 and $AlPO_4$-11, having pore sizes in the range 6.1–8.0 Å, appear to exclude triglyceride molecules, which, based on computer models, have a minimum cross-section, including Van der Waal's radii, of about 10–11 Å. Thus, the separation mechanism for $AlPO_4$-5 and $AlPO_4$-11 appears to be based on size or shape selectivity and the selectivity factor ($\beta$), defined hereinafter, is infinite. Thus, aluminophosphate molecular sieves having a pore size from about 6.1 Å to about 8 Å are preferred in the invention. However, the reasons for selectivity (i.e., non-adsorption) of triglycerides using $AlPO_4$-54 is not as clear, since the aforementioned 12.5 Å pore size, determined by crystallography, does not include Van der Waal's radii. The calculated pore size is reduced by about 3 Å if Van der Waal's are considered. Hence, triglycerides may also be excluded from the $AlPO_4$-54 pore system, although the relevant dimensions are not as disparate as in the case of $AlPO_4$-5 and $AlPO_4$-11. It is possible, however, that other factors, e.g., Van der Waal forces or other electrostatic forces may be operating to provide the desired selectivity between fatty acids and triglycerides if the triglyceride molecules are in fact not excluded from the pores of $AlPO_4$-54. Notwithstanding the reasons for the selectivity of $AlPO_4$-54, however, it is expected that the large pore size will result in higher mass transfer rates than the smaller pore sized $AlPO_4$-5 and $AlPO_4$-11.

The water content of the adsorbent affects the separation capacity and exchange rates and may also affect its stability. Acceptable levels of water in the adsorbent in terms of LOI are from 0 to 10% (wt.), preferably from 0–2% (wt.). To reduce water content to the desired level, $AlPO_4$-11 may be dried in air, nitrogen, or other gas at elevated temperature. $AlPO_4$-54 may be dried by application of vacuum, maintaining the temperature initially at room temperature until most of the water is removed, then raising the temperature to 50 ° C. while maintaining vacuum.

The general scheme for the rejective adsorption separation such as practiced here is known. Briefly, the less adsorbed feed component(s) is eluted from the non-selective void volume and weakly adsorbing volume before the more strongly adsorbed component(s). The relatively unadsorbed component(s) is thereby recovered in the raffinate. A particular advantage of such a system lies where the unadsorbed fraction or component is large in relation to the other fraction or components, since substantially less adsorbent and smaller sized equipment is required for a given feed throughput than if the large fraction is selectively adsorbed on the adsorbent.

Although both liquid and vapor phase operations can be used in many adsorptive separation processes, liquid-phase operation is preferred for this process because of the lower temperature requirements and because of the higher yields of extract product that can be obtained with liquid-phase operation over those obtained with vapor phase operation. Adsorption conditions will include a temperature range of from about 25° C. to about 200° C. and a pressure sufficient to maintain liquid-phase, ranging from about atmospheric to about 400 psig, with from about atmospheric to about 200 psig usually being adequate. Desorption conditions will include the same range of temperatures and pressures as used for adsorption conditions.

At least a portion of the raffinate stream, which contains the concentrated mixed triglycerides product, and preferably at least a portion of the extract stream, from the separation process are passed to separation means, typically fractionators or evaporators, where at least a portion of desorbent material is separated to produce a raffinate product and an extract product, respectively.

The desorbent material for the preferred isothermal, isobaric, liquid-phase operation of the process of my invention comprises a low molecular weight ketone having from 3–8 carbon atoms. The ketones include acetone, methyl ethyl ketone, diethyl ketone, methylbutyl ketone, 2-heptanone, 3-heptanone, dipropyl ketone, 2-octanone, 3-octanone, etc. Mixtures of the ketones with hydrocarbon liquids, e.g., paraffinic liquids, are useful as desorbents because of their ability to modify the strength of the desorbent. Ethers and esters, mixtures thereof and mixtures thereof with hydrocarbons such as paraffins may also be used. The esters include methyl butyrate, ethyl butyrate, methyl amylate, ethyl amylate, etc. The ethers include ethyl ether, methyl-t-butyl ether, phenyl ether, 3 methoxyhexane, anisob, glyme, diglyme, etc.

A dynamic testing apparatus is employed to test various adsorbents with a particular feed mixture and desorbent material to measure the adsorption characteristics of retention, capacity and exchange rate. The apparatus consists of a helical adsorbent chamber of approximately 70 cc volume having inlet and outlet portions at opposite ends of the chamber. The chamber is contained within a temperature control means and, in addition, pressure control equipment is used to operate the chamber at a constant predetermined pressure. Quantitative and qualitative analytical equipment such as refractometers, polarimeters and chromatographs can be attached to the outlet line of the chamber and used to detect qualitatively, or determine quantitatively, one or more components in the effluent stream leaving the adsorbent chamber. A pulse test, performed using this apparatus and the following general procedure, is used to determine data, e.g., selectivily, for various adsorbent systems. The adsorbent is placed in a chamber and filled to equilibrium with a particular desorbent material by passing the desorbent material through the adsorbent chamber. At a convenient time, a pulse of feed containing known concentrations of a tracer or of a raffinate component, or both, and of a particular extract component, all diluted in desorbent material is injected for a duration of several minutes. Desorbent material flow is resumed, and the tracer or the raffinate component (or both) and the extract component are eluted as in a liquid-solid chromatographic operation. The effluent can be analyzed onstream, or, alternatively, effluent samples can be collected periodically and later analyzed separately by analytical equipment and traces of the envelopes or corresponding component peaks developed.

From information derived from the test, adsorbent performance can be rated in terms of void volume, retention volume for an extract or a raffinate component, the rate of desorption of an extract component from the adsorbent and selectivity. The retention volume of an extract or a raffinate component may be characterized by the distance between the center of the peak envelope of the extract or raffinate component and the center of the peak envelope of the tracer component (void volume) or some other known reference point. It is expressed in terms of the volume in cubic centimeters of desorbent material pumped during this time interval represented by the distance between the peak envelopes. The rate of exchange or desorption rate of an extract component with the desorbent material can generally be characterized by the width of the peak envelopes at half intensity. The narrower the peak width, the faster the desorption rate. Selectivity, $\beta$, is determined by the ratio of the net retention volumes of the more strongly adsorbed component to each of the other components.

The examples shown below are intended to further illustrate the process of this invention without unduly limiting the scope and spirit of said process.

EXAMPLE I

A pulse test as described above was performed to evaluate the process of the present invention for separating free fatty acids from triglycerides. The column was filled with 70 cc of $AlPO_4$-11 adsorbent and maintained at a temperature of 60° C. and a pressure to provide liquidphase operations. The feed was 2 cc of a synthetic mixture simulating an interesterification reaction product consisting of a mixture of 1.5 cc desorbent, and 0.23 g each of oleic acid, diolein (dioleyl glyceride) and triolein (trioleyl glyceride).

The desorbent was 2-heptanone. The desorbent material was run continuously at a nominal liquid hourly space velocity (LHSV) of 1 (1.29 ml per minute flow rate). At some convenient time interval, the desorbent was stopped and the feed mixture was run for a 1.55 minute interval at a rate of 1.29 ml/min. The desorbent stream was then resumed at I LHSV and continued to pass into the adsorbent column until all of the feed components had been eluted from the column as determined by analyzing the effluent stream leaving the adsorbent column. The result of the analyses obtained is shown in FIG. 1. The triglyceride product is removed as raffinate near the void volume. The results are also set forth in the following Table 1 of gross retention volumes (GRV), net retention volumes (NRV) and selectivities ($\beta$).

TABLE 1

| Component | GRV | NRV | Selectivity ($\beta$) |
|---|---|---|---|
| Triolein | 48.1 | 0.0 | ∞ |
| Diolein | 48.9 | 0.8 | 12.5 |
| Oleic Acid | 58.9 | 10.0 | 1.00 (Ref.) |

In this pulse test, it is shown that diglycerides may be removed with the triglycerides, which in some cases may be advantageous, if diglycerides may be acceptable and desirable components of food products made from fats and oils.

In another pulse test under the same conditions, 2 cc of a solution containing 0.25 gm triolein, 0.25 gm stearic acid, and 1.5 cc desorbent was separated into the triglyceride component and saturated fatty acid component with the following results indicating clear separation of free fatty acids and triglycerides:

TABLE 2

| Component | GRV | NRV |
|---|---|---|
| Triolein | 48.1 | 0.0 |
| Stearic Acid | 60.4 | 12.2 |

Figure 2:
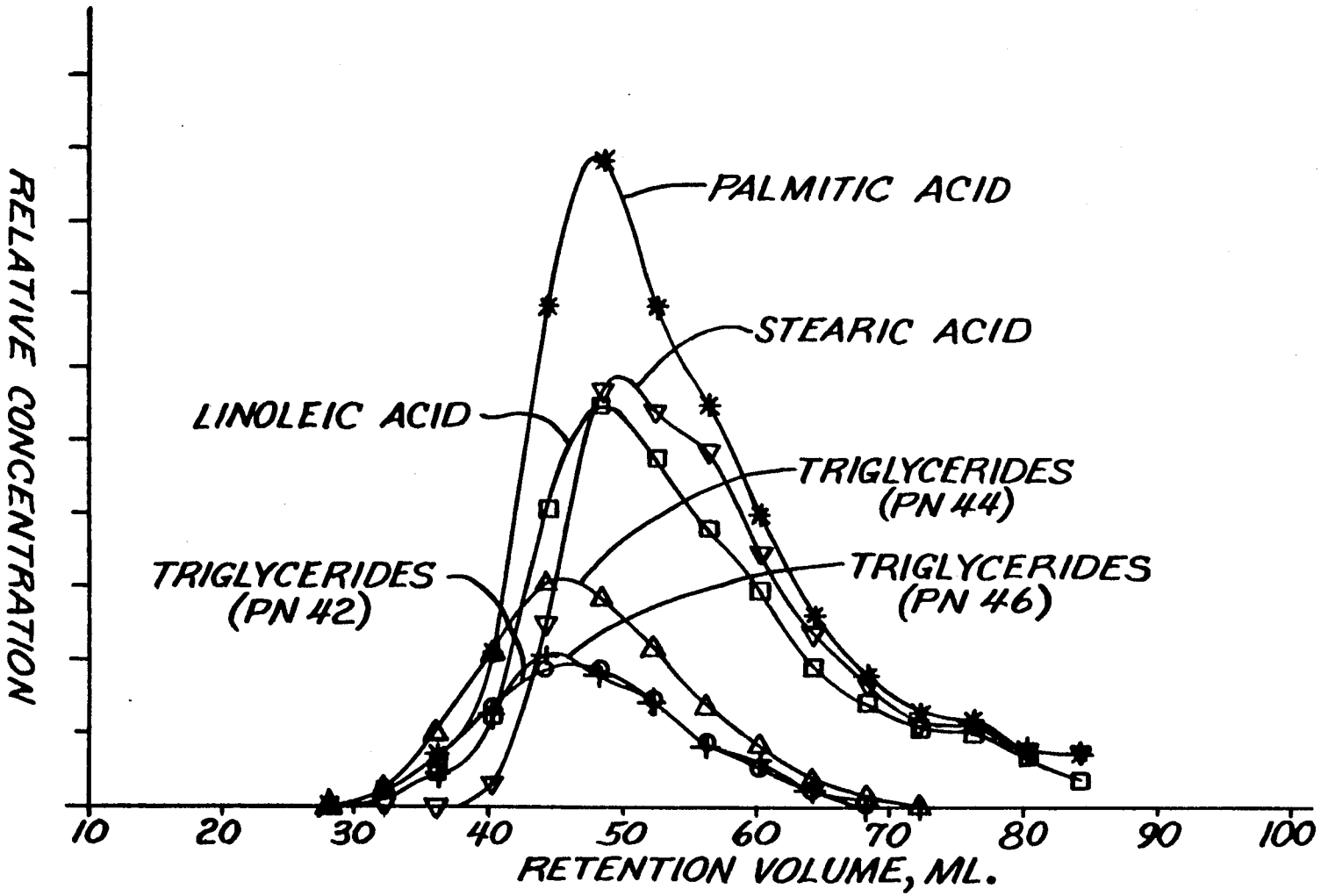

In a third pulse test obtained in separate steps, using the same adsorbent and under the same conditions, but using acetone as the desorbent, retention volumes and selectivies were determined for saturated and unsaturated fatty acids (stearic, palmitic and linoleic acids) and triglycerides. In the first step, 2 cc of a solution containing 0.5 gm RBD corn oil and 1.5 cc desorbent was introduced and eluted from the column. The corn oil triglyceride content, in terms of partition numbers, PN, was PN 40=0.79%, PN 42=24.36%, PN 44=39.40%, PN 46=26.23%, and PN 48=9.22%, where the PN of a triglyceride is defined as the number of carbon atoms in the fatty acid moieties less twice the number of double bonds. Thus, =42; dioleyl-linoleyl triglyceride (LOO) has PN32 46, etc. All the triglycerides were recovered from adsorbent at approximately the void volume (as the raffinate). In the second step, 2 cc of a solution containing 0.25 gram each linoleic, stearic, and palmitic acids, and 1.2 cc acetone was introduced to the column. The fatty acids were also recovered as a group by desorbing the $AlPO_4-11$ with acetone. The combined results of the two tests are shown in FIG. 2 and the following Table 3:

TABLE 3

| Component | GRV | NRV | Selectivity ($\beta$) |
|---|---|---|---|
| Triglycerides (PN 42) | 46.6 | 0.2 | ∞ |
| Triglycerides (PN 44) | 46.6 | 0.2 | ∞ |
| Triglycerides (PN 46) | 46.4 | 0.0 | ∞ |
| Palmitic Acid | 50.4 | 3.8 | 1.76 |
| Linoleic Acid | 51.5 | 4.9 | 1.37 |
| Stearic Acid | 53.3 | 6.7 | 1.00 (Ref.) |

EXAMPLE II

Figure 3:
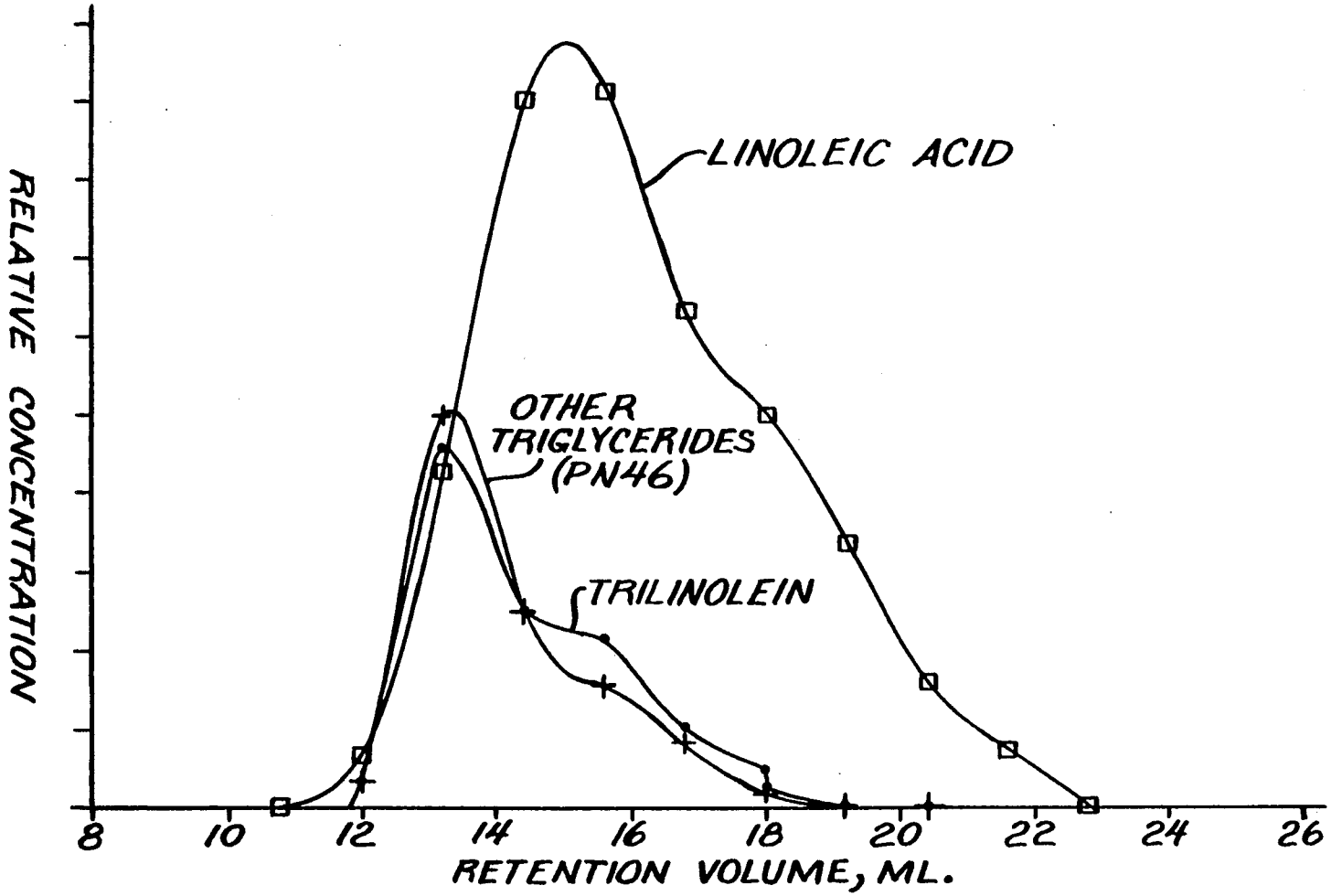
FIG. 3 is a chromatographic trace of the pulse test of Example II showing the separation of free fatty acids from triglycerides with $AlPO_4$-54 and a mixture of acetone and hexane as the desorbent.

Another pulse test was run on a 15 cc column, in the same fashion as Example I, except that the column temperature was 55° C. and the flow volume was 0.60 ml/min. The adsorbent was $AlPO_4$-54. The feed was 2 cc of a mixture of 1.5 cc desorbent, 0.2 g of the RBD (refined, bleached, and deodorized) corn oil described in Example I and 0.2 g technical grade linoleic acid. The technical grade linoleic acid was approximately 80% linoleic acid, with the balance being oleic acid and linolenic acid. The desorbent was 30% (vol.) acetone in n-hexane. The results of the separation are shown in the plot of FIG. 3 and the following Table 4, and indicate that $AlPO_4$-54 is selective for fatty acids over triglycerides, with essentially group separation of all acids from all triglycerides.

TABLE 4

| Component | GRV | NRV | Selectivity ($\beta$) |
|---|---|---|---|
| Triglycerides (PN 46) | 13.5 | 0 | $\infty$ |
| Triglycerides (PN 42) | 13.8 | 0.3 | 7.67 |
| Total Fatty Acids | 15.8 | 2.3 | 1.00 (Ref.) |

Thus, it is clear from the above that the use of a crystalline aluminophosphate enables the separation of glycerides from a mixture containing glycerides and free fatty acids. Since the effects of different operating conditions on the product purity and yield have not been completely investigated, the results of the above tests are not intended to represent the optimums that might be achieved.

What is claimed is:

1. A process for separtating free fatty acids and glycerides from a mixture comprising free fatty acids and at least one glyceride, said process comprising contacting said mixture at adsorption conditions with an adsorbent comprising a crystalline aluminophosphate molecular sieve thereby selectively adsorbing said free fatty acids thereon, removing said glycerides from contact with said adsorbent and desorbing said free fatty acids at desorption conditions with a desorbent comprising a liquid selected from the group consisting of lower ketones having from 3–8 carbon atoms.

2. The process of claim 1 wherein said adsorption and desorption conditions include a temperature within the range of from about 20° C. to about 200° C. and a pressure sufficient to maintain liquid phase.

3. The process of claim 1 wherein said glyceride is at least one triglyceride.

4. The process of claim 3 wherein said feed mixture additionally contains diglycerides.

5. The process of claim 3 wherein said ketone is 2-heptanone.

6. The process of claim 3 wherein said ketone is acetone.

7. The process of claim 1 wherein said desorbent additionally contains a normal alkane.

8. The process of claim 1 wherein said aluminophosphate has a pore size of at least about 6.1 Å.

9. The process of claim 8 wherein said aluminophosphate has a pore size of from about 6.1 Å to about 12.5 Å.

10. The process of claim 8 wherein said aluminophosphate is selected from the group consisting of $AlPO_4$-5, $AlPO_4$-11 and $AlPO_4$-54.

* * * * *